United States Patent [19]

Rohald et al.

[11] Patent Number: 4,951,484

[45] Date of Patent: Aug. 28, 1990

[54] LOCK AND KEY COMBINATION

[75] Inventors: Stanley S. Rohald, Johannesburg; Llewellyn De Wet, Roodepoort, both of South Africa

[73] Assignee: Nova International Corporation C.C., Johannesburg, South Africa

[21] Appl. No.: 328,215

[22] Filed: Mar. 24, 1989

[30] Foreign Application Priority Data

Mar. 30, 1988 [ZA] South Africa ..... 88/2273

[51] Int. Cl.[5] ..... E05B 69/00

[52] U.S. Cl. ..... 70/59; 70/346; 70/404; 211/4; 223/85; 292/DIG. 38

[58] Field of Search ..... 70/404, 346, 336, 344, 70/409, 347, 57, 59, 58, 57.1; 292/DIG. 38; 211/4; 223/85, 88

[56] References Cited

U.S. PATENT DOCUMENTS 1,079,655 11/1913 Lissner ..... 70/59 X
4,391,111 7/1983 Marcy ..... 70/346 X
4,534,586 8/1985 Smith ..... 292/DIG. 38 X
4,674,303 6/1987 Salcone, II ..... 70/63

FOREIGN PATENT DOCUMENTS 0226684 7/1987 European Pat. Off. .
2386670 12/1978 France ..... 292/DIG. 38
934838 8/1963 United Kingdom ..... 70/404

*Primary Examiner*—Lloyd A. Gall
*Attorney, Agent, or Firm*—Browdy and Neimark

[57] ABSTRACT

A lock and key combination comprising a latch (14), means (17) for mounting the latch about an axis of rotation, means (20) for biasing the latch towards a locking position, means (22) associated with the latch for rotating it and having a non-circular form, and a key (19) adapted to mate with the non-circular form of the means for rotating the latch, the key permitting the latch to be displaced about its axis of rotation against the biasing means.

9 Claims, 3 Drawing Sheets

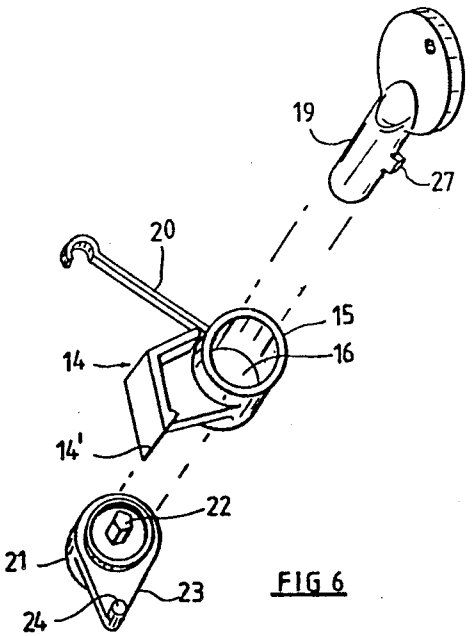
FIG 6
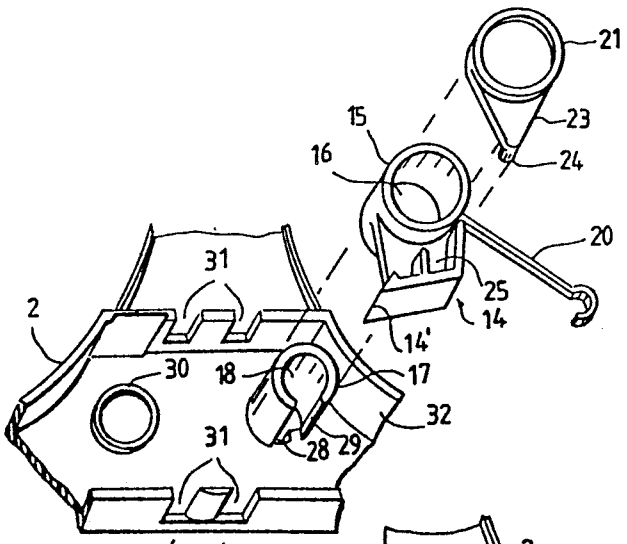
FIG 4
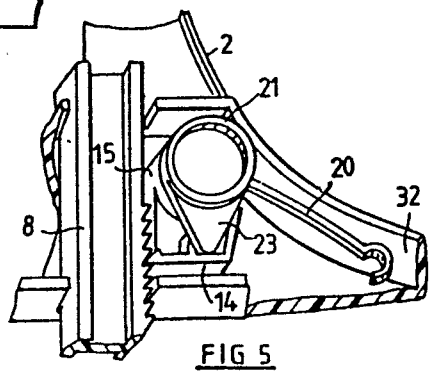
FIG 5
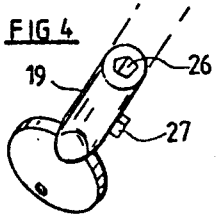

LOCK AND KEY COMBINATION

FIELD OF THE INVENTION This invention relates to a lock.

BACKGROUND OF THE INVENTION

One kind of article to which a lock of the invention has application is a clothes hanger which is arranged to carry clothing in such a manner that the clothing cannot be removed from the hanger unless the hanger is unlocked. This type of hanger is usually referred to as a security hanger. In the case of security hangers it is necessary to supply the hangers to clothing stores and the like in batches where a single key can unlock an entire batch of hangers. However, such a key must not be capable of being readily duplicated by a locksmith for if that were the case the purpose of the security hanger could be defeated. A conventional tumbler lock with a metal key is therefore not suitable for use on security hangers. It is an object of the invention to provide a lock and key combination which is of simple construction, is effective in use and which meets the abovementioned requirement.

SUMMARY OF THE INVENTION

According to the invention a lock and key combination comprises a latch, means for mounting the latch about an axis of rotation, means for biasing the latch towards a locking position, means associated with the latch for rotating it and having a non-circular form, and a key adapted to mate with the non-circular form of the means for rotating the latch, the key permitting the latch to be displaced about its axis of rotation against the biasing means.

The key is preferably a barrel key having a socket, the means for rotating the latch comprising a pin receivable in the socket of the key.

The means for mounting the latch may comprise a boss having a bore for receiving the barrel key, the latch comprising a hub itself having a bore adapted to seat on the boss. The latch may be made from plastics material and the means for biasing the latch may comprise an elongate arm extending radially from the hub and adapted to be so engaged with the housing that it provides a bias by virtue of its resilience.

The pin associated with the latch may be formed integrally on an end plate adapted to seat on the hub of the latch and having a formation arranged to be trapped on the latch to prevent rotation of the end plate relative to the hub.

The barrel key may have a lug on the exterior of its barrel and the boss carrying the hub of the latch may have a recess therein to permit entry of the lug on the barrel of the key. In such a case the boss will have a rebate along at least part of the length of its recess permitting rotation of the barrel of the key within the boss but limiting the extent of such rotation.

The key is preferably moulded from a hard polymeric material.

The invention is further concerned with a security hanger having a lock as hereinabove defined.

DESCRIPTION OF THE DRAWINGS

A preferred embodiment of the invention will now be described by way of example with reference to the accompanying drawings in which;

FIGS. 4 to 6 are perspective views of the lock and key combination of the invention.

DESCRIPTION OF PREFERRED EMBODIMENT

Figure 1:
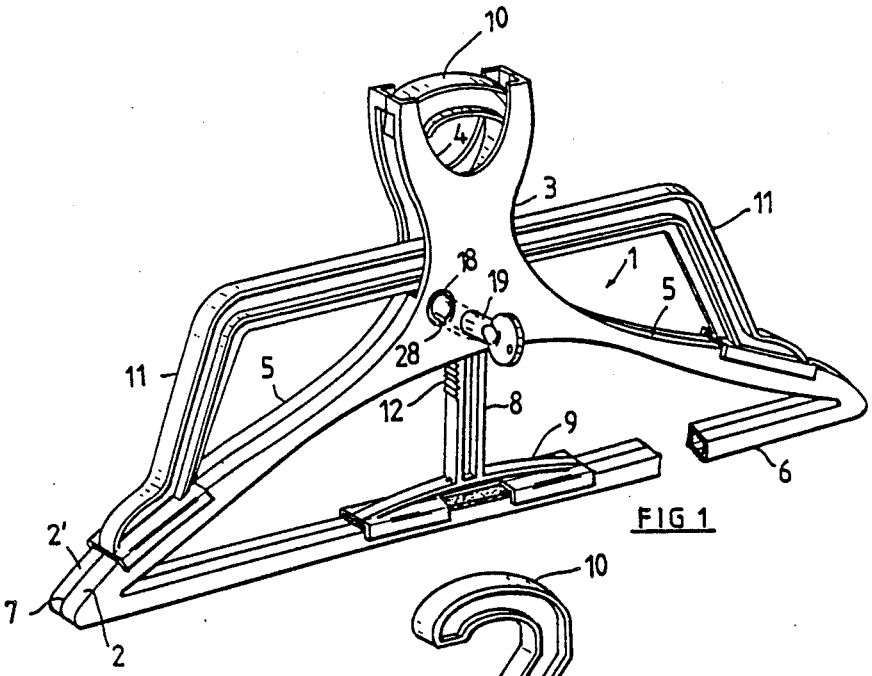
FIGS. 1 and 2 are perspective views of a security hanger carrying a lock in accordance with the invention.
Figure 2:
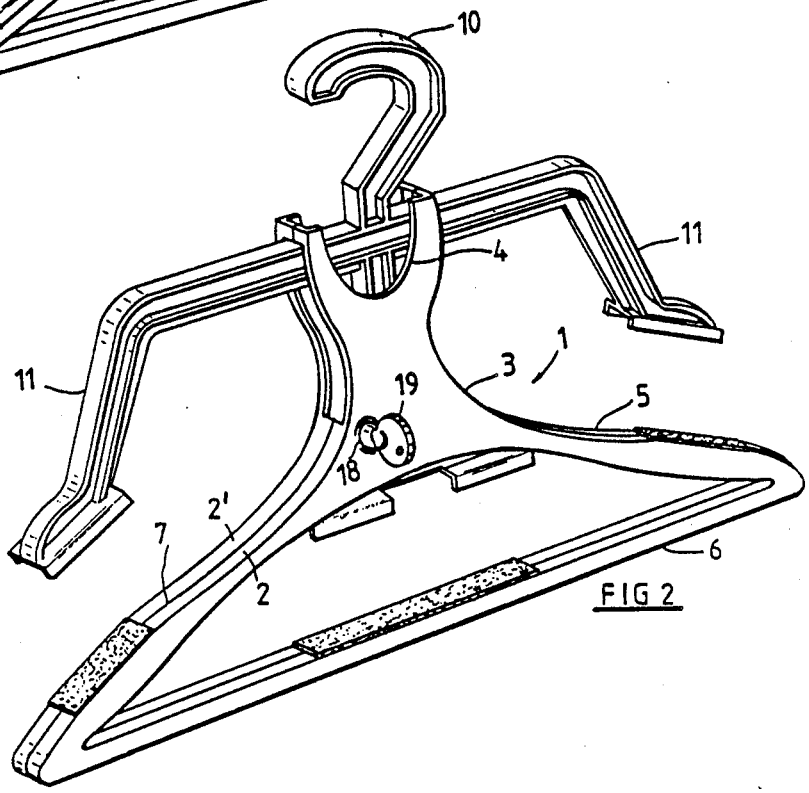

With reference to FIGS. 1 and 2 a security hanger for clothing comprises a hanger 1 having a neck 3 with a recess 4 at its upper end. The hanger 1 has sloping sides 5 and a horizontal crossbar 6. The hanger 1 is made of two identical halves 2, 2' which are bonded together in opposed relationship along a joint 7, forming a hanger with a hollow interior.

The neck 3 of the hanger 1 accommodates a rack 8 mounted for rectilinear movement in the neck 3. The rack 8 has a foot 9 at its lower end, a hook 10 at its upper end and a pair of lateral arms 11. The rack 8 has a serrated formation 12 along a part of its height and is associated with a lock 13 constructed in accordance with the invention and mounted within the neck 3 of the hanger 1 (FIG. 3).

The security hanger can carry articles of clothing (not shown) on the sloping sides 5 of the hanger 1 and on the crossbar 6 thereof. When the security hanger is in a closed position shown in FIG. 1 the clothing is trapped against removal from the hanger. In order to remove the clothing the lock 13 is operated to permit the rack 8 to be displaced to an open position shown in FIG. 2, whereupon the clothing may be removed.

The security hanger can be suspended from a rail or the like (not shown) by means of the hook 10. In the closed position of the hanger shown in FIG. 1, the rail can nest in the recess 4 of the neck 3, in which position the hook 10 prevents removal of the hanger from the rail.

Figure 3:
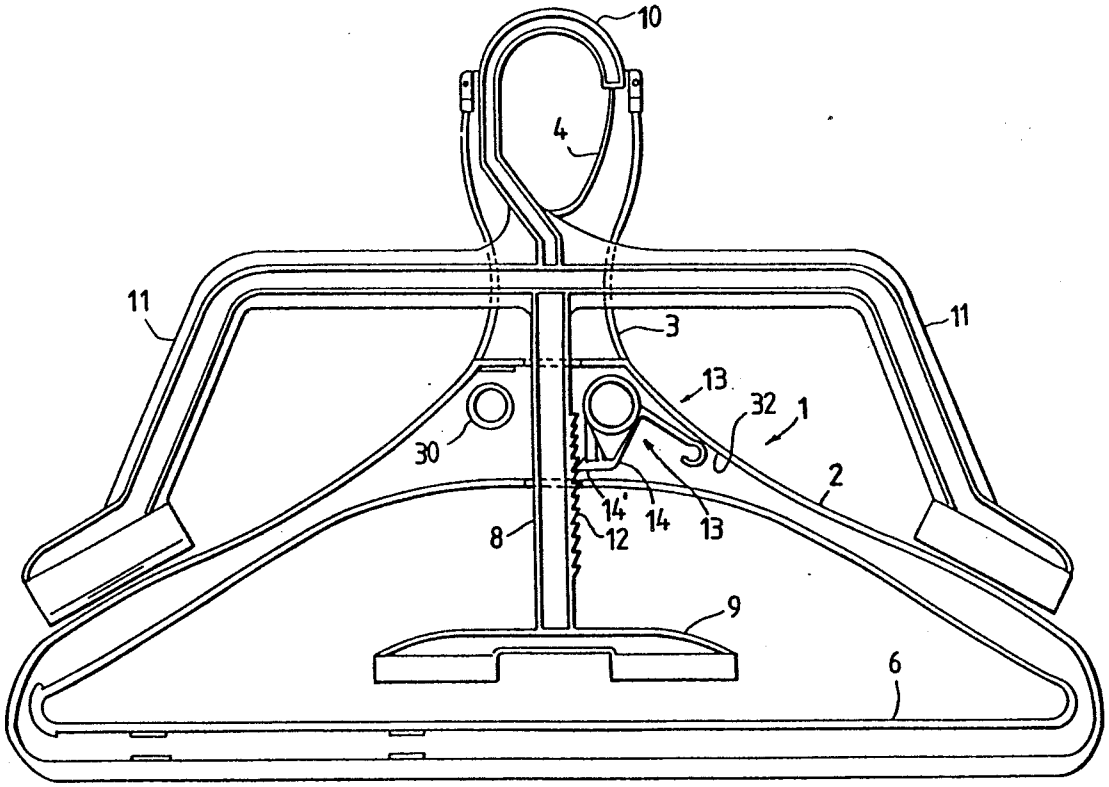
FIG. 3 is a plan view of the security hanger of FIGS. 1 and 2 with part of the hanger removed showing the lock in position.

With reference to FIG. 3 the security hanger is shown in plan view with one half 2' of the hanger removed. As shown the lock 13 is mounted to one side of the rack 8 and has a latch 14 with a point 14' which engages the serrated formation 12 on the rack 8. In order to release the latch 14 from such engagement it is rotated in an anti-clockwise direction in FIG. 3.

The lock 13 is shown in greater detail in FIGS. 4 to 6. The latch 14, which may be injection moulded from any suitable plastics material such as polypropylene, includes a hub 15 having a bore 16 which seats on a boss 17 formed integrally on the hanger 1. The boss 17 itself has a bore 18 to accommodate the barrel of a barrel key 19 for operating the lock. The hub 15 of the lock has an elongate arm 20 extending radially therefrom and integral therewith. The arm 20 is arranged to engage a surface 32 of the hanger 1 so that it serves to bias the latch 14 towards engagement with the rack 8, the bias being provided by virtue of the resilient nature of the plastics material from which the arm 20 is formed.

An end plate 21 is provided which seats on the hub 15 of the latch 14. The end plate 21, which may also be injection moulded from a similar plastics material, has a pin 22 formed integrally therewith which has a cross-section other than circular, in this case, pentagonal (FIG. 6). The end plate 21 has a flange 23 with a lug 24 at its free end which is trapped in a trap 25 provided on the latch 14. When the lug 24 is thus trapped the end plate 21 is prevented from rotating relative to the latch 14 and the pin 22 thus provides means for rotating the latch about its axis. The end plate 21 carrying the pin 22 is moulded separately from the latch bolt 14 to render the latter less complex and to facilitate the provision of pins 22 of different configurations. In this way end plates 21 with different pin configurations can be fitted to the latch 14 without having to alter the latch mould.

A barrel key 19 is provided which operates the latch bolt 14. The barrel key has a socket 26 (FIG. 4) which mates with the pin 22 permitting the latch to be displaced about its axis against the bias of the arm 20. In this embodiment of the invention the barrel key 19 is preferably moulded from a hard plastics material such as an acetal resin. One such suitable resin is sold under the registered trade mark Delrin 500F by Du Pont. In this embodiment of the invention the barrel key 19 has a lug 27 on the exterior of its barrel. To enable the barrel to pass into the bore 18 of the boss 17, a recess 28 is provided in the hanger half 2 (FIG. 4). The lug 27 thus serves to align the socket 26 of the key with the pin 22 to ensure that the socket mates with the pin. In order to permit the key to be rotated in the bore 18 of the boss 17 and hence to displace the latch 14, a rebate 29 is provided in the boss 17. The rebate 29 also serves to limit rotation of the key to an extent only sufficient to permit the point 14' of the latch 14 to clear the rack 8.

The key 19 is dedicated to the hanger 1 by virtue of the provision of the recess 28 therein and being a barrel key made of plastics material, cannot readily be reproduced by a locksmith. In order to provide keys dedicated to different hangers it is sufficient angularly to shift the mould inserts (not shown) which are used to provide the recess 28 and rebate 29 in the hanger 1, always ensuring that the socket 26 mates with the pin 22 when the barrel of the key 19 is inserted in the bore 18. Keys 19 may also be provided with their lugs 27 located at different angular positions. In addition, different mating configurations may of course be used for the pin 22 and the key socket 26.

FIGS. 4 and 5 show how the lock 13 is mounted on the boss 17 of the hanger half 2. Adjacent the boss 17 is an upstanding ring formation 30 formed integrally with this hanger half (FIG. 4). The ring formation 30 is spaced the same distance from the center of the hanger half as the boss 17. Because the two hanger halves 2, 2' making up the hanger 1 are identical, the ring formation 30 on the hanger half 2' will align with the boss 17 when the two hanger halves are joined. In this way the ring formation 30 on the hanger half 2' serves to engage and hold the end plate 21 of the lock 13 in position when the two hanger halves are joined.

In FIG. 4 recesses 31 are shown in the hanger half 2 which serve to trap and locate the rack 8 for rectilinear movement in the neck of the hanger 1.

Thus the invention provides a useful lock and key combination for use in a security hanger. Not only is the lock and key combination effective in a security hanger, but being made of injection moulded plastic parts is less expensive than conventional lock and key combinations. It is however not confined to such use and may be used on other articles and for other purposes. In the embodiment of the invention described above, the neck of the hanger 1 provides a housing to the lock 14. Any other structure may of course be used to provide such housing.

Many other embodiments of the invention may be made differing in detail from the embodiment described above and without departing from the scope of the invention as defined in the appended claims.

We claim:

1. A lock and key combination operable in a housing, comprising:
   - a latch, having a hub mounted on a boss provided on the housing so as to permit rotation of the latch about an axis of rotation;
   - means for biasing the latch towards a locking position;
   - an end plate adapted to seat on the hub of the latch and arranged to be trapped on the latch to prevent rotation of the end plate relative to the latch, the end plate carrying a pin of non-circular form;
   - a barrel key having a socket adapted to engage said pin of the end plate to permit the latch to be displaced about its axis of rotation against the means for biasing the latch.

2. A lock and key combination as claimed in claim 1 in which the pin associated with the latch is formed integrally on an end plate adapted to seat on the hub of the latch and having a formation arranged to be trapped on the latch to prevent rotation of the end plate relative to the hub.

3. A lock and key combination as claimed in claim 1 in which the barrel key has a lug on the exterior of its barrel and the boss carrying the hub of the latch has a recess therein to permit entry of the barrel of the key.

4. A lock and key combination as claimed in claim 1 in which the key is moulded from a polymeric material.

5. A security hanger having a lock and key combination as claimed in claim 1.

6. A lock and key combination as claimed in claim 1 in which the latch is made of plastics material, the means for biasing the latch comprising an elongate arm extending radially from the hub and adapted to be so engaged with said housing that it provides a bias by virtue of its resilience.

7. A lock and key combination as claimed in claim 1 in which the barrel key has a lug on the exterior thereof and the housing on which the boss is provided which carries the hub of the latch has a rebate therein to permit entry of the lug of the key.

8. A lock and key combination as claimed in claim 7 in which the boss has a rebate therein limiting the extent of travel of the lug on the barrel key and hence the extent of rotation of the barrel of the key within the boss.

9. A lock and key combination operable in a housing, comprising;
   - a latch, having a hub mounted on a boss provided on the housing so as to permit rotation of the latch about an axis of rotation;
   - means for biasing the latch towards a locking position;
   - a pin associated with the latch for rotating it and having a non-circular form;
   - a barrel key receivable in a bore in said boss and having a socket adapted to engage said pin to permit the latch to be displaced about its axis of rotation against the means for biasing the latch, the barrel key having a lug on the exterior thereof, the housing on which said boss is provided having a recess therein to permit entry of the lug of the key, said boss having a rebate therein limiting the extent of travel of said lug on the barrel key and hence the extent of rotation of the barrel of the key within the boss.

* * * * *